US010718236B2

(12) United States Patent
Batscha et al.

(10) Patent No.: US 10,718,236 B2
(45) Date of Patent: Jul. 21, 2020

(54) TURBINE SHAFT BEARING AND TURBINE APPARATUS

(71) Applicant: ORMAT TECHNOLOGIES, Inc., Reno, NV (US)

(72) Inventors: Dany Batscha, Kiriat Ono (IL); Oren Ram, Rehovot (IL); Anton Fiterman, Moshav Shani Livnat (IL); Ran Reshef, Bat Hefer (IL); Herzel Sharoni, Rehovot (IL); Uri Kaplan, Doar Na Emek Soreq (IL)

(73) Assignee: ORMAT TECHNOLOGIES, INC., Reno, NV (US)

( * ) Notice: Subject to any disclaimer, the term of this patent is extended or adjusted under 35 U.S.C. 154(b) by 0 days.

(21) Appl. No.: 15/269,140

(22) Filed: Sep. 19, 2016

(65) Prior Publication Data

US 2018/0080341 A1 Mar. 22, 2018

(51) Int. Cl.
*F01K 7/34* (2006.01)
*F01K 25/10* (2006.01)
(Continued)

(52) U.S. Cl.
CPC ..... *F01K 7/34* (2013.01); *F01D 5/06* (2013.01); *F01D 25/162* (2013.01);
(Continued)

(58) Field of Classification Search
CPC ..... F01D 25/16; F01D 25/162; F01D 25/125; F01D 9/065; F01D 25/164; F01D 25/18;
(Continued)

(56) References Cited

U.S. PATENT DOCUMENTS 1,811,302 A * 6/1931 Church ..... F01K 7/38 60/667
2,414,814 A * 1/1947 Johnson ..... F01D 25/162 184/104.1
(Continued)

FOREIGN PATENT DOCUMENTS

DE 1126408 B * 3/1962 ..... F01K 7/42

OTHER PUBLICATIONS

International Search Report dated Feb. 26, 2018 in International Application No. PCT/IB 17/55528, 6 pages.
(Continued)

*Primary Examiner* — Mark A Laurenzi
*Assistant Examiner* — Xiaoting Hu
(74) *Attorney, Agent, or Firm* — Oblon, McClelland, Maier & Neustadt, L.L.P.

(57) ABSTRACT

A turbine shaft bearing apparatus in a turbine module includes two axially spaced turbine shaft bearings, including an outlet side bearing protected from overheating by a solid bearing housing which surrounds the outlet side bearing. The bearing housing being provided with a support including conduit for a lubricating medium. The turbine module has plurality of axially spaced turbine wheels connected to a common turbine shaft and coaxial therewith; an inlet through which motive fluid vapor is introduced to a first stage of the turbine wheels; a structured bleeding exit opening formed in an outer turbine casing of the turbine module; and a passage defined between two of the turbine wheels and in fluid communication with the bleeding exit opening, wherein expanded motive fluid vapor may be extracted through the structured bleeding exit opening and supplied to a heat exchange component for heating the motive fluid condensate.

21 Claims, 11 Drawing Sheets

(51) Int. Cl.

| | |
|---|---|
| ***F01K 7/38*** | (2006.01) |
| ***F01D 5/06*** | (2006.01) |
| ***F01D 25/16*** | (2006.01) |
| ***F01D 25/18*** | (2006.01) |

(52) U.S. Cl.
CPC ..... *F01D 25/183* (2013.01); *F01K 7/38* (2013.01); *F01K 25/10* (2013.01); *F05D 2220/31* (2013.01); *F05D 2240/60* (2013.01)

(58) Field of Classification Search
CPC . F01D 25/183; F01K 7/34; F01K 7/42; F01K 25/10; F01K 7/38; F01K 7/40; F01K 25/08–106; F22D 1/003; F22D 1/28; F22D 1/32; F22D 1/325; F22D 1/34
USPC ..... 60/671, 677, 678, 653
See application file for complete search history.

(56) References Cited

U.S. PATENT DOCUMENTS 2,484,952 A * 10/1949 Ledwith ..... F01D 25/18 184/6
2,616,662 A * 11/1952 Mierley ..... F01D 9/065 415/199.5
4,069,674 A * 1/1978 Warren ..... F01K 7/40 60/641.8
5,080,555 A * 1/1992 Kempinger ..... F01D 9/065 415/108
5,743,094 A * 4/1998 Zimron ..... F01D 5/02 415/176
5,836,162 A * 11/1998 Haynes ..... F01K 7/40 60/663
6,030,176 A * 2/2000 Oeynhausen ..... F01D 9/065 415/111
6,298,663 B1 * 10/2001 Bronicki ..... F03G 7/04 60/641.2
6,422,017 B1 * 7/2002 Bassily ..... F01K 7/40 60/653
6,821,083 B2 * 11/2004 Lathrop ..... F01D 25/26 415/108
8,091,361 B1 * 1/2012 Lang ..... F01K 3/002 60/653
8,616,835 B2 * 12/2013 Hashimoto ..... F01D 9/065 415/142
8,739,541 B2 * 6/2014 Ast ..... F01K 23/065 60/651
9,359,919 B1 * 6/2016 Berry ..... F01K 25/106
2006/0236699 A1 * 10/2006 Klochko ..... F01K 25/08 60/671
2007/0095066 A1 * 5/2007 Kaplan ..... F01K 23/02 60/670
2011/0167826 A1 * 7/2011 Uehara ..... F01K 7/38 60/671
2011/0259010 A1 * 10/2011 Bronicki ..... F22B 3/04 60/651
2011/0314819 A1 * 12/2011 Muthuramalingam ... F01K 7/34 60/678
2013/0025278 A1 * 1/2013 Batscha ..... F03G 7/04 60/641.2
2015/0159516 A1 * 6/2015 Spadacini ..... F01D 1/06 60/651
2016/0230657 A9 8/2016 Ethier et al.

OTHER PUBLICATIONS

International Written Opinion dated Feb. 26, 2018 in International Application No. PCT/IB 17/55528, 8 pages.
International Preliminary Report on Patentability dated Mar. 28, 2019 in PCT/IB2017/055528 (submitting English translation only).

* cited by examiner

TURBINE SHAFT BEARING AND TURBINE APPARATUS

FIELD OF THE INVENTION

The present invention relates to the field of power plants. More particularly, the invention relates to turbine shaft bearing apparatus that supports a turbine of a novel configuration to help in increasing the total power output of a single turbine module.

BACKGROUND

Due to the worldwide environmental considerations particularly relating to use of energy resources, it has become, recently more important to utilize relatively medium to low temperature heat sources or resources, such as geothermal steam and/or geothermal brine as well as industrial waste heat, for power production.

An Organic Rankine Cycle (ORC) is well suited to exploit the energy content of a medium to low temperature heat source or resource due to the relatively low boiling point of organic motive fluid. Organic fluid flowing in a closed cycle vaporizes after extracting heat from the medium to low temperature heat source or resource. The vapor is expanded in an organic vapor turbine that converts heat in the vapor to work and produces heat-depleted or expanded organic vapor that is condensed in a condenser. The condensed organic fluid is returned to the vaporizer, and the cycle is repeated.

An important consideration in designing the power capacity of such a power plant is the selection of a suitable turbine configuration. Reliable operation of the turbine is contingent upon the structural strength of the shaft that enables turbine rotor rotation and upon the ability of the bearings that support the turbine shaft to absorb both the radial load and axial thrust imposed by the expansion of the motive fluid within the turbine.

One prior art bearing arrangement for supporting a rotating turbine shaft is an overhang design illustrated in FIG. 1. To support the mechanical load imposed by three turbine wheels 2, 3 and 4 which permit the expansion of the working fluid in separate stages carried on turbine shaft 6, two bearings 7 and 8 are provided at the inlet end 5 of turbine shaft 6, which is proximate to the port through which the working fluid is introduced into the turbine interior, and are distant from the outlet end 9 of turbine shaft 6 being close to the port from which the expanded working fluid exits the turbine. The overhang bearing arrangement simplifies assembly and maintenance as both bearings 7 and 8 are at the same side of shaft 6; however, it reduces the maximum mechanical load that can be supported due to the high bending stress that the turbine shaft experiences. Due to the proximity of the two bearings, the moment arm resulting from the weight of the turbine wheels which is applied on the shaft is unidirectional, producing a significantly large moment that causes the shaft to be susceptible to bending.

It is to be noted that the maximum number of turbine wheels that can be supported by the overhang bearing arrangement is usually limited to three as a result of the bending stress, significantly reducing the power output of a turbine from what could be achieved if more turbine wheels could be incorporated therewith.

Another disadvantage of the overhang bearing arrangement is that the end of the turbine shaft that is unsupported by the bearings can undergo an induced vibration phenomena, particularly flexural vibration. Such vibration can result in damage to elements with small radial clearance such as seals.

WO 2013/171685 discloses an ORC system that comprises a radial turbine of the axial inflow and radial outflow type. The turbine is formed by a single rotor disc that carries rotor blades to define a plurality of stages and that is provided with an auxiliary opening between two successive radially spaced stages. The auxiliary opening is interposed between an inlet and an outlet of the turbine, and is in fluid connection with an auxiliary cogeneration circuit so as to extract from the turbine or inject into it organic working fluid at an intermediate pressure between an injection pressure and a discharge pressure. The rotor disc is supported in a casing by two bearings, and is mounted at an end of the shaft that is cantilevered with respect to the casing according to an overhang design.

Since the vapors expand radially outwardly from the turbine shaft in this prior art configuration, large mechanical loads are imposed on the turbine shaft and on the bearings. The various radially spaced stages of the single rotor disc are very closely fitted to the stator blades, and are therefore very sensitive to expansion and contraction forces, particularly due to the application of radial forces to the stages. The applied radial forces increase for the second and third stages, which are more distant from the turbine shaft than the first stage.

Other disadvantages of this single turbine wheel configuration relate to the need of accommodating the large-sized and heavy rotor that has a correspondingly high moment of inertia, requiring an increased torque to drive the rotor, and also to the pressure losses of the vapor exiting the turbine via a 90-degree turn through a volute.

Another prior art bearing arrangement for supporting a turbine shaft is the rotor between bearings design where two bearings are axially spaced. Although the level of bending stress and vibrations is significantly reduced relative to the overhang bearing arrangement by virtue of the axially spaced bearings, one or both of the bearings may be exposed to the hot and pressurized motive fluid vapors. Due to the exposure to the hot vapors, the metal temperature of a turbine shaft bearing is liable to become excessive. As a result of bearing overheating, metal or alloy based lining having good lubricating properties tends to become weakened and shears in the direction of shaft rotation. Without protection for the metal or alloy lining, the bearing surface geometry can become altered due to the metal-to-metal contact between the bearing and the shaft, ultimately leading to possible bearing failure and an unsupported turbine shaft. At times, the sheared metal or alloy blocks the oil inlet to the bearing, resulting in another cause of bearing failure.

In addition, the rotor between bearings design has been utilized only with respect to steam turbines. Thermal stress present in steam turbines is not similar to the thermal stress that may be present in organic vapor turbines.

It is an object of the present invention to provide turbine shaft bearing apparatus for use in a rotor between bearings design that is not subject to overheating.

It is an additional object of the present invention to provide turbine shaft bearing apparatus to facilitate an increase of the total power output of the turbine and of a power plant in which the turbine is incorporated.

It is an additional object of the present invention to provide a turbine module apparatus to facilitate an increase of the total power output of the turbine and of a power plant in which the turbine is incorporated.

It is an additional object of the present invention to provide turbine shaft bearing apparatus to facilitate efficient utilization of relatively low temperature heat sources or resources.

Other objects and advantages of the invention will become apparent as the description proceeds.

SUMMARY

The present invention provides a turbine shaft bearing apparatus, comprising two axially spaced, inlet side and outlet side bearings for providing support to a turbine shaft to which are connected a plurality of turbine wheels such that said turbine shaft, said two spaced bearings, and said plurality of turbine wheels are all coaxial, wherein said outlet side bearing is protected from overheating by motive fluid expanded by one or more of said plurality of turbine wheels or stages by a solid bearing housing which surrounds said outlet side bearing which is supported and provided with a conduit through which a lubricating medium for lubricating said outlet side bearing is supplied from a port external to said turbine.

The present invention is also directed to a single turbine module, comprising a plurality of axially spaced turbine wheels, each of which constitutes one expansion stage of said turbine module, being connected to a common turbine shaft and coaxial therewith; an inlet through which motive fluid vapor is introduced to a first stage of said turbine wheels; a structured bleeding exit opening formed in an outer turbine casing of said turbine module; and a passage defined between two of said turbine wheels and in fluid communication with said bleeding exit opening, wherein expanded motive fluid vapor is extracted through said structured bleeding exit opening and is supplied to a heat exchange component, for heating the motive fluid condensate.

The present invention is also directed to a power enhanced Organic Rankine Cycle (ORC) based power plant, comprising an organic vapor turbine adapted for interstage bleeding of organic motive fluid; a direct recuperator to which interstage-bled motive fluid is extracted and wherein said interstage-bled motive fluid is brought into direct contact with liquid condensate of the motive fluid; and a vaporizer for vaporizing said directly recuperated motive fluid so that vaporized motive fluid is supplied to said turbine.

DETAILED DESCRIPTION

Figure 1:
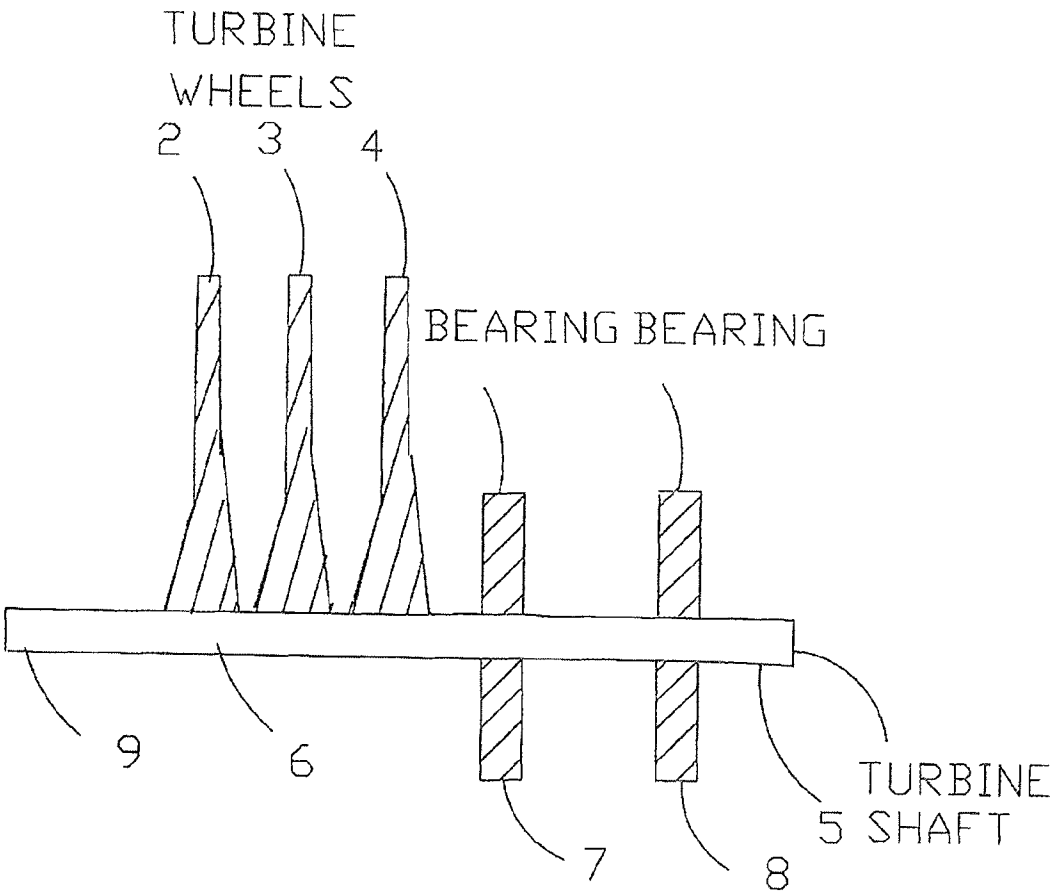
FIG. 1 PRIOR ART
FIG. 1 is a partial cross sectional view and partial outline view of half a longitudinal section through a prior art turbine, showing a prior art bearing arrangement according to the overhang design.
Figure 2:
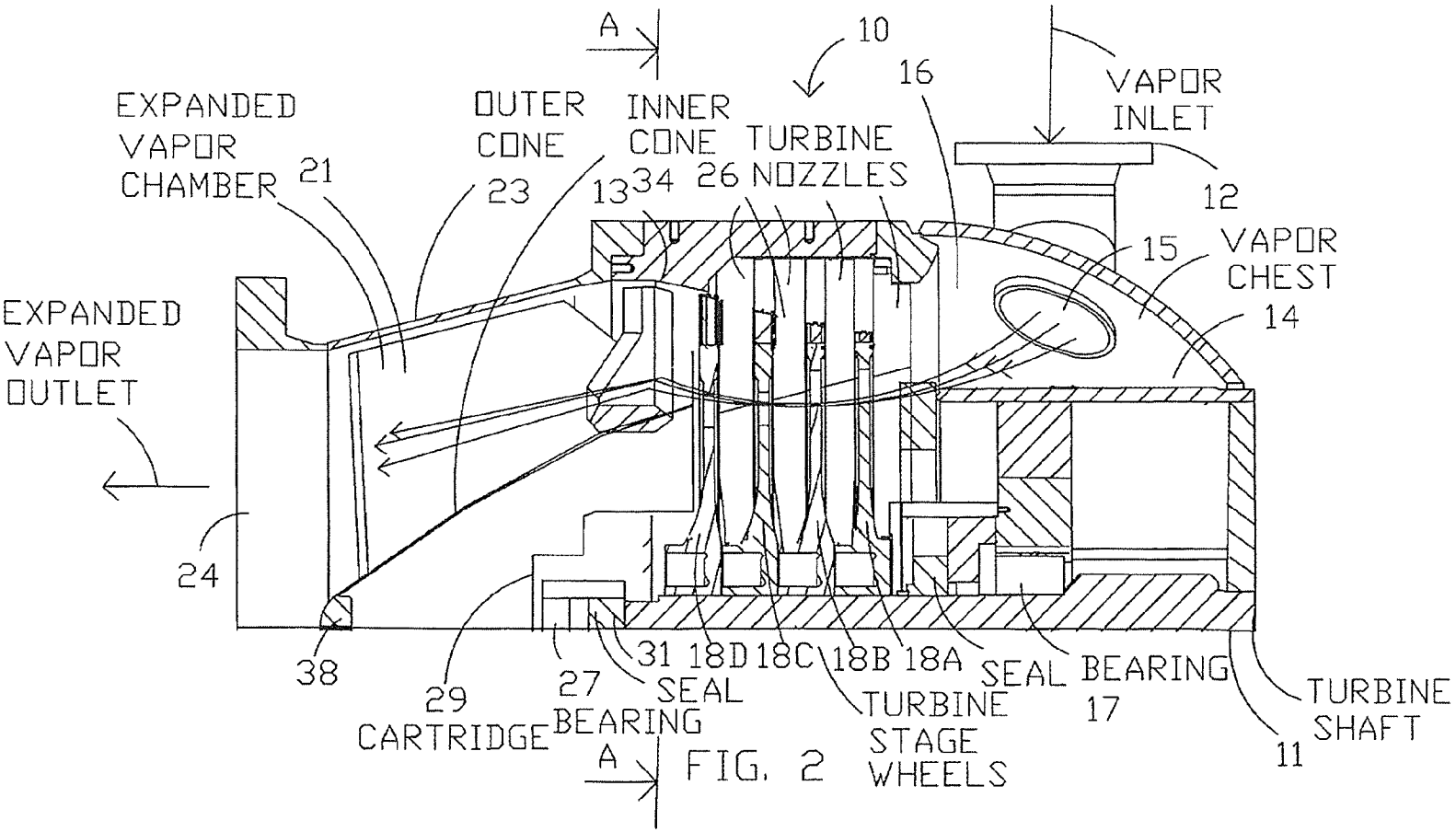
FIG. 2 is a cross sectional view of half a longitudinal section through a turbine according to one embodiment of the present invention, showing a novel bearing housing.

FIG. 2 illustrates turbine 10 that incorporates novel turbine shaft bearing apparatus, according to one embodiment of the present invention. Turbine 10 is suitable for expanding organic motive fluid, particularly for use in producing power in an ORC-based power plant, but is also applicable to expanding other types of motive fluid as well, such as steam.

Turbine 10 can advantageously actually be considered of an axial flow type. Motive fluid vapor is introduced via radial inlet 12 into vapor chest 14 which provides an efficient inlet for the turbine, and is axially discharged to turbine wheels 18A-D via vapor chest exit 16. The rotatable turbine wheels 18A-D, fixed and connected to turbine shaft 15, by e. g. a ring fedder connection, are provided in a chamber defined by the radial space between turbine shaft 15 and annular turbine housing 13, which is axially adjacent to vapor chest 14 and radially adjoining outer turbine casing 19. Herein, four turbine wheels and their use is described and shown but, if desired, according to the present invention, another number of turbine wheels can be used.

Each of the turbine wheels 18A-D comprises one expansion stage of turbine 10. The rotatable blades carried by a turbine wheel of a given stage interact with a corresponding set of fixed blades that are attached to turbine housing 13 and are arranged as a ring, often referred to as a nozzle ring 26 so that the fixed blades or openings act as nozzles. The motive fluid is introduced to nozzle ring 26, which causes a partial decrease in pressure and a partial increase in velocity of the motive fluid. The stream of increased-velocity motive fluid is directed onto the corresponding rotating blades of the given expansion stage to utilize the kinetic energy of the motive fluid.

This process is carried out for each expansion stage, so that the motive fluid is increasingly expanded by the blades carried by each of turbine wheels 18A-D, such that the expanded vapor exiting the last stage turbine wheel 18D flows through expanded vapor chamber 21, located downstream to the turbine wheels. Expanded vapor chamber 21 is coincident with convergent outer cone 23 extending from turbine casing 19, and the expanded motive fluid exits turbine 10 via outlet 24, which is axially spaced from inlet 12. The expanded motive fluid vapor exiting outlet 24 is directed to the condenser of the power plant or to a heat exchange component in fluid communication therewith.

This axial inflow and outflow configuration facilitates axial expansion, so that the vapor-derived forces applied to turbine shaft 15 are substantially evenly distributed. Turbine shaft 15, which is usually coupled to an electric generator, is consequently caused to rotate by these vapor-derived expansion forces and to generate electric power.

Figure 5:
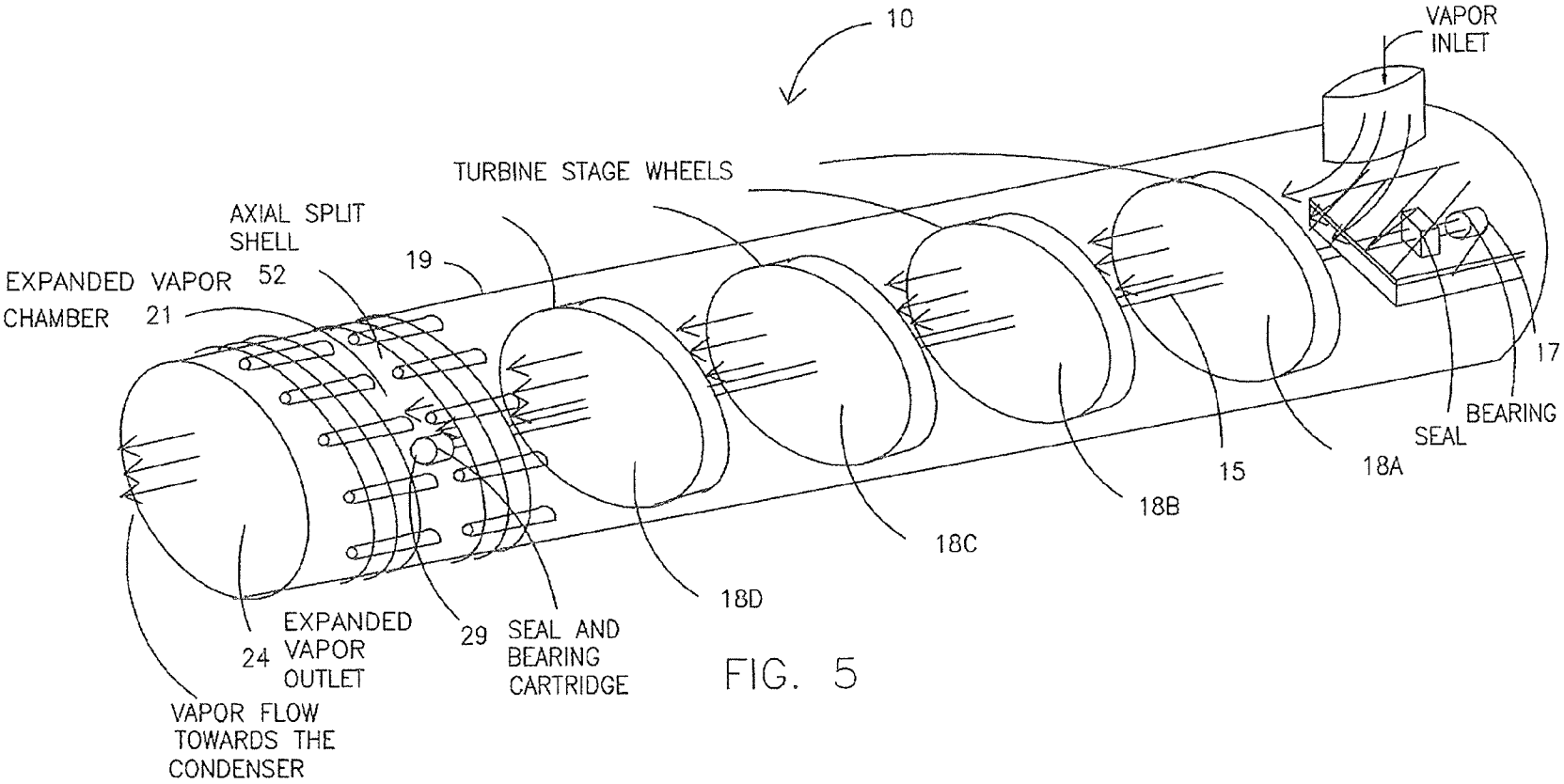
FIG. 5 is a perspective schematic view of a turbine according to another embodiment of the invention.

In turbine 10, turbine shaft 15 is properly positioned and rotatably supported by two axially spaced bearings 17 and 27 in accordance with a rotor between bearings design, such that turbine shaft 15, bearings 17 and 27, and turbine wheels 18A-D are all coaxial, as also shown in FIG. 5. By virtue of the rotor between bearings design by which the two bearings 17 and 27 are located at opposite ends of turbine shaft 15, the tensile strength of the turbine shaft is maintained. The increased tensile strength provides turbine shaft 15 with the capability of physically supporting a plurality of axially spaced turbine wheels, such as at least four axially spaced turbine wheels 18A-D, without being susceptible to bending, as opposed to the prior art overhang bearing arrangement that permits usually only up to three turbine wheels to be supported by the turbine shaft. The increased number of turbine stages in turn results in an increase in the total power output produced by the turbine, for example, of the order of 3%, without having to increase the radial dimension of the turbine wheels. Turbine 10 is generally rotationally balanced even with the addition of the fourth turbine wheel.

As a result of the axial flow of the motive fluid produced within vapor chest 14 and thereafter to turbine wheels 18A-D, inlet-side bearing 17 is not exposed to the high temperature of the motive fluid, and therefore may be of conventional configuration, for example a spherical roller bearing adapted to handle a combined load associated with both a load imposed by the pressure differential applied by the motive fluid vapor between inlet 12 and outlet 24 and another load associated with the weight applied of the rotating turbine shaft 15. Alternatively, inlet side bearing 17 may also be a bearing based on ball bearings. Outlet side bearing 27 located proximate to expanded vapor chamber 21, however, is liable to be exposed to the relatively high temperature of the expanded motive fluid, and would be subject to overheating if it were not protected.

In the bearing apparatus of the present invention, outlet side bearing 27 is encased within a solid protective cartridge or bearing housing 29 in order to be isolated from the expanded motive fluid. Bearing housing 29 encompasses outlet-side bearing 27. Bearing housing 29 also provides sufficient cooling and lubrication of outlet-side bearing 27, so as to prevent the latter from overheating if contacted or otherwise exposed to the hot expanded motive fluid.

A seal 31 is also positioned within bearing housing 29 to protect outlet-side bearing 27 from being impinged by hot unexpanded motive fluid, resulting for example from passage radially inwardly along the turbine wheels and axially along turbine shaft 15. Seal 31 is in sealing engagement with both the turbine shaft and the outlet-side bearing facing turbine shaft 11, to prevent ingress thereto of the hot motive fluid.

Exemplary bearing types that may be used for outlet side bearing 27 include a carb bearing and a cylindrical roller bearing in order to support the turbine shaft despite any thermal expansion of the turbine shaft that may take place. Roller bearings are particularly suitable for use with an organic motive fluid by virtue of their resistance to frictional losses.

Turbine 10 may be configured with an inner convergent cone 34 within an inner region of expanded vapor chamber 21, to provide additional means for isolating outlet side bearing 27 from the expanded motive fluid and for guiding the expanded motive fluid towards outlet 24. Inner cone 34 extends from an intermediate region of radially extending partition 37, which is positioned at the downstream side of final stage turbine wheel 18D and connected to turbine housing 13, to support element 38 located proximate to the turbine's longitudinal axis 11 and adjacent to outlet 24.

Figure 3:
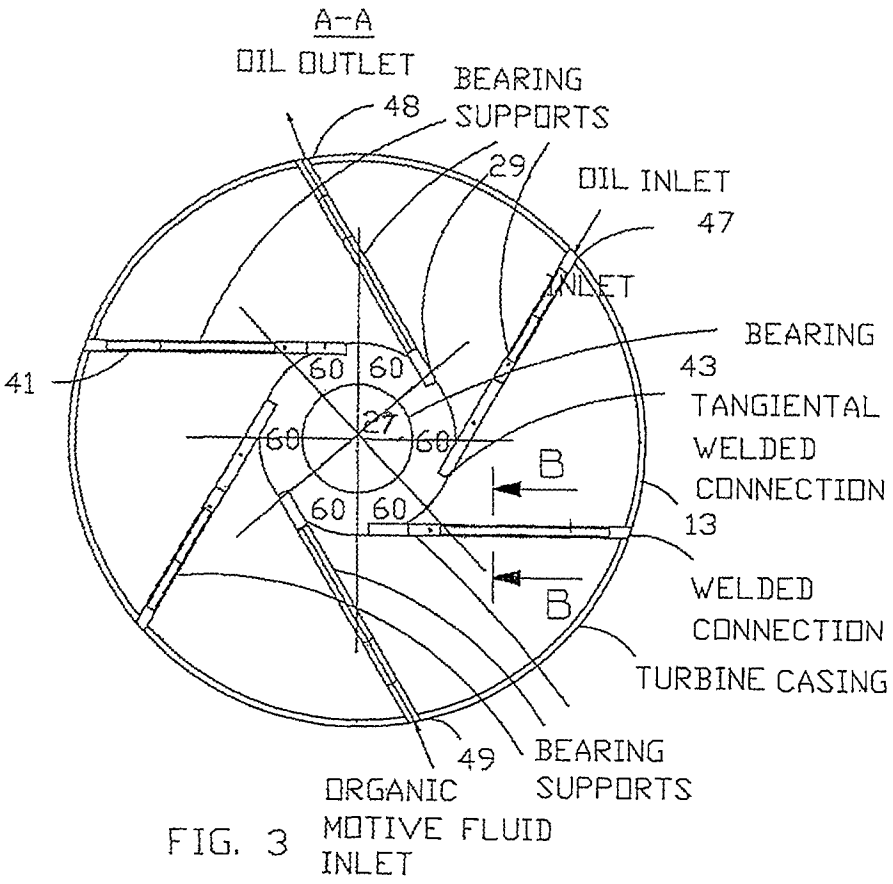
FIG. 3 is a cross sectional view of the turbine housing cut about plane A-A of FIG. 2, showing supports that are connected to the bearing housing.

FIG. 3 illustrates a cross sectional view of the turbine housing, to illustrate structural elements that are connected to the bearing housing 29. Schematically illustrated, outlet-side bearing 27 at times is subjected to a moment and in order to immobilize bearing housing 29 and maintain the location of bearing 27 and to provide bearing support against bearing loads, a plurality of elongated and angularly spaced bearing supports 41 are each connected to a corresponding peripheral region of bearing housing 29 and to a different region of turbine housing 13. Each bearing support 41 may be tangentially connected to the tubular bearing housing 29, which may have been milled to accommodate the provision of a welded connection 43 to the corresponding bearing support. The tangential connection of each bearing support 41 to bearing housing 29 advantageously provide means for dealing with possible thermal expansion of the bearing supports 41.

In the illustrated configuration, six evenly spaced bearing supports 41 are provided, with an angular interval of 60° between each bearing support. It will be appreciated that any other number of symmetrical bearing supports 41, i.e. two or more, may also be used.

With bearing 27 being contained within closed bearing housing 29, and therefore not being accessible to a separate supply of lubrication, one or more bearing supports 41 are bored to provide the supply of cooling fluid.

A first bearing support 41 is bored with an inlet 47 through which cooling fluid, e.g. lubrication oil, is injected through the wall of bearing housing 29 to the surface of outlet-side bearing 27. A second bearing support, which may be adjacent to the first bearing support, is provided with a bore 48 from which the spent cooling fluid, e.g. lubricating oil, is extracted from bearing 27. A third bearing support is formed with a bore 49 through which cooled motive fluid, e.g. supplied with motive fluid condensate, is injected to further cool the outlet side bearing 27. As bearing 27 normally undergoes an increase in temperature due to friction during rotation of the turbine shaft, the injected motive fluid evaporates shortly after contacting the bearing surface of increased temperature and consequently brings about the cooling of the bearing as well as seal 31. Furthermore, the pressure of the cooling fluid, e.g. thermal oil, can be adjusted to control the axial force applied by the turbine shaft.

Figure 4:
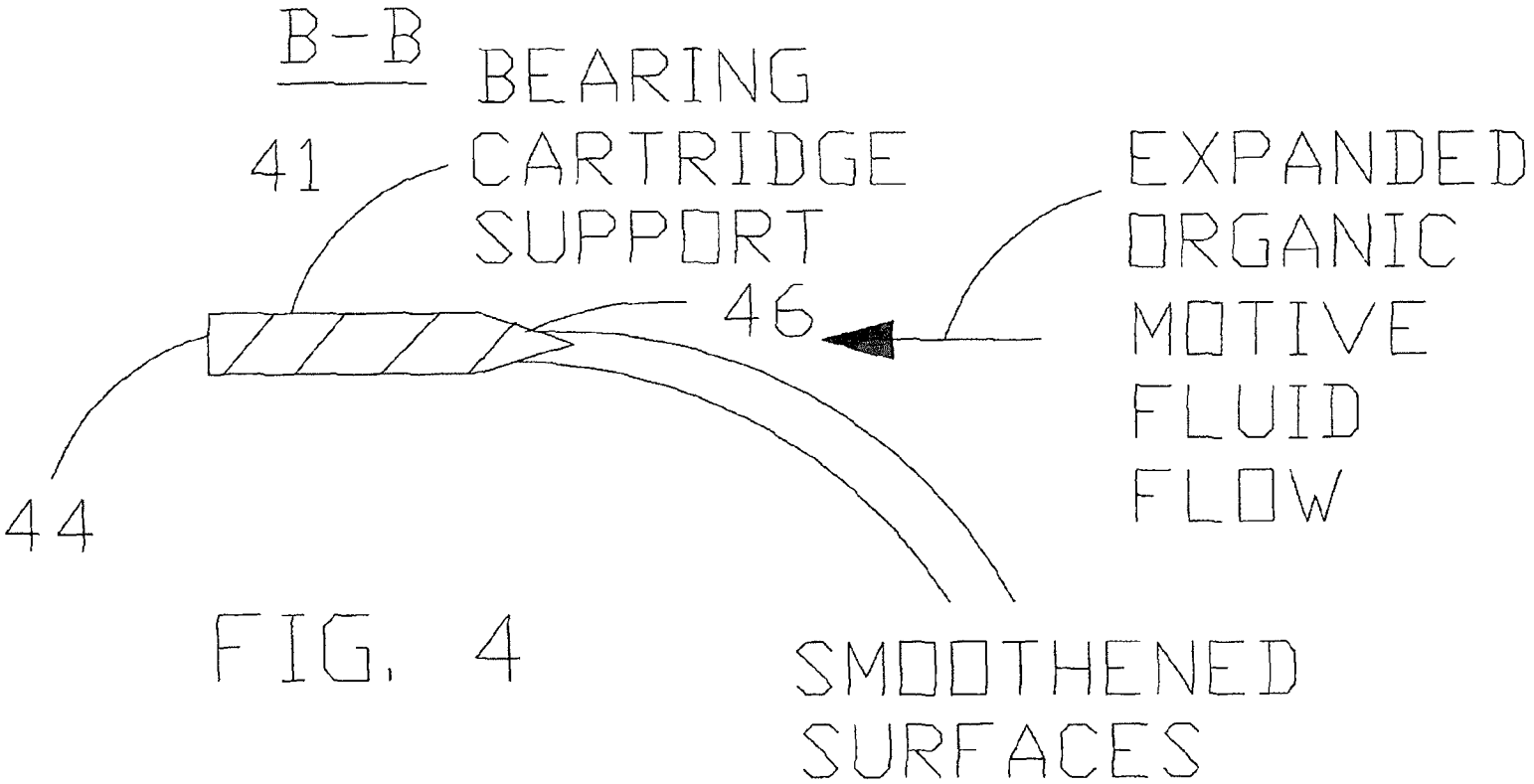
FIG. 4 is a cross sectional of a bearing support, cut about plane B-B of FIG. 3, showing its smoothened configuration.

As shown in FIG. 4, each bearing support 41 extending from the bearing housing through the expanded vapor chamber to the turbine housing, and protruding through the inner cone, when the turbine is configured with an inner cone, has a smoothened configuration to reduce flow disturbances while the expanded vapors flow across the bearing support. Consequently, while the trailing end 44 of a bearing support 41, i.e. the end facing away from the direction of flow of the expanded motive fluid, may be straight, the leading end 46 facing the direction of flow of the expanded motive fluid vapor is arcuate and smoothened without any abrupt discontinuities.

Referring now to FIG. 5, turbine 10 may be configured with an axial split design whereby turbine casing 19 has an annular shell 52 to facilitate access to turbine shaft 15 and to turbine wheels 18A-D via a hatch or any other type of opening, for purposes of maintenance. Shell 52 is advantageously positioned within a region of casing 19 that encircles expanded vapor chamber 21 and is proximate to the exit of the expanded motive fluid from the last expansion stage 18D as it flows towards outlet 24. The pressure of the expanded motive fluid, usually organic expanded motive fluid, at this region is relatively low so that leakage caused by the axial split shell 52, if any, will cause only a marginal reduction in the total power produced by the power plant, since the power produced is a result of motive fluid expansion by wheels 18A-D.

Alternatively, the turbine casing may be configured with a radial split design to facilitate access to the turbine shaft and to the turbine wheels via the radial split whenever needed.

Although the description relates to a turbine of the axial flow type, i.e. axial inflow and outflow, it will be appreciated that the teachings of the present invention are also applicable to other types of turbines, such as the radial inflow type or the radial outflow type.

As was previously explained, the rotor between bearings design allows an additional turbine wheel or wheels to be mounted to the turbine shaft by virtue of the increased tensile strength of the turbine shaft. In addition to providing an increase in the total power output of the turbine, the added turbine wheel facilitates, if desired, interstage bleeding.

Figure 6:
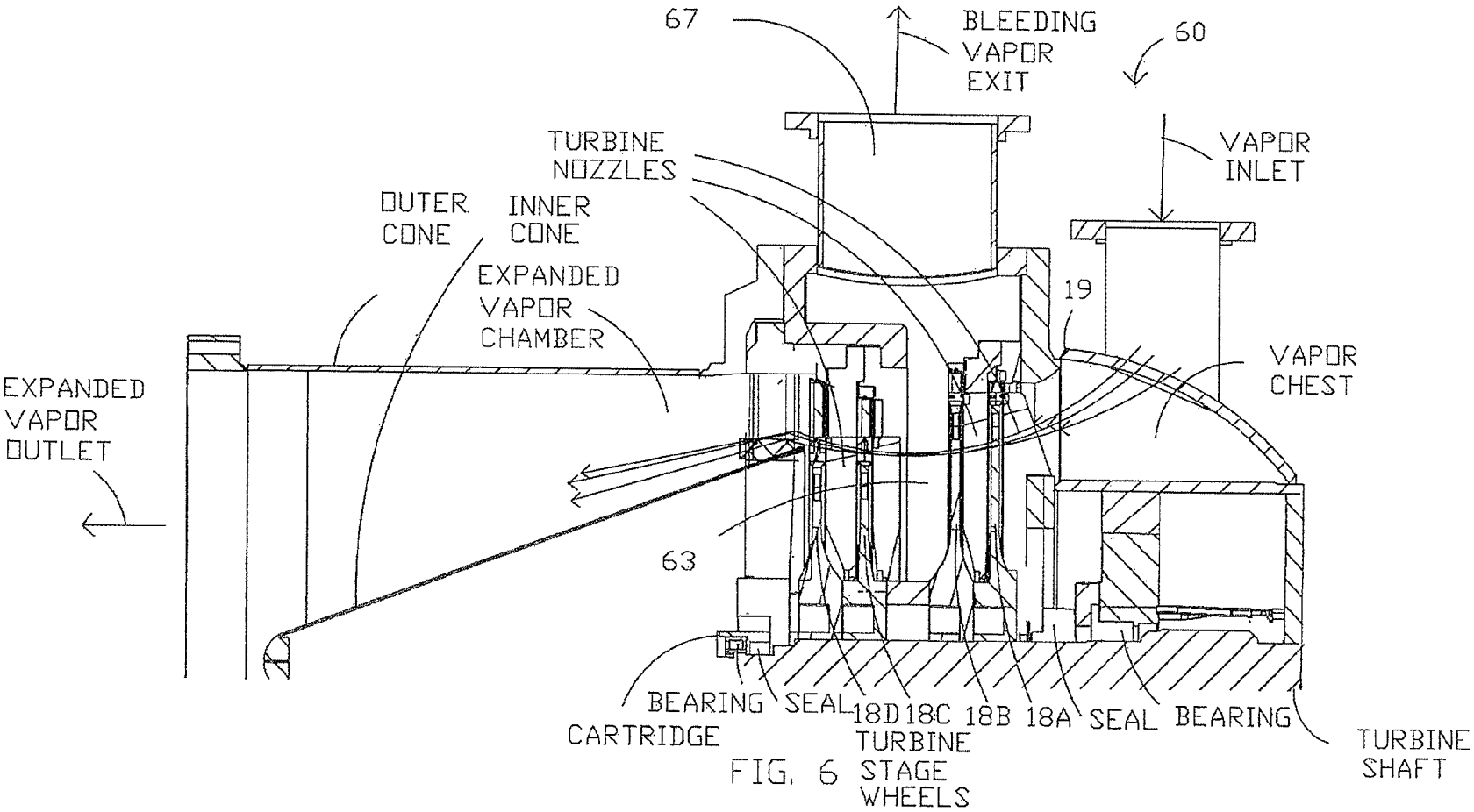
FIG. 6 is a cross sectional view of half a longitudinal section through a turbine according to another embodiment of the invention which is configured with a passage that facilitates interstage bleeding.

FIG. 6 illustrates turbine 60, which is similar to turbine 10 of FIG. 2, but with the addition of a passage 63 that is shown to be provided between second stage turbine wheel 18B and third stage turbine wheel 18C, but which can also be provided between first stage turbine wheel 18A and second stage turbine wheel 18B or between third stage turbine wheel 18C and fourth stage turbine wheel 18D. Passage 63 extending to, and in communication with, bleeding exit 67 may be defined by a complete axial separation between two adjacent turbine wheels that enables the flow of motive fluid vapor, usually organic motive fluid vapor, from the exit of the moving blades at a previous stage prior to being introduced to the nozzle ring of a subsequent stage. The bled motive fluid vapor that is extracted through bleeding exit 67, which is a structured opening formed in turbine casing 19, flows to a heat exchange component of the power plant, within which motive fluid condensate is heated, to assist in increasing the energy content of the motive fluid to be supplied to first stage turbine wheel 18A.

The flow capacity of the motive fluid extracted by interstage bleeding is controlled by the pressure differential of the motive fluid pressure at bleeding exit 67 and at the heat exchange component, and also by the target temperature of the motive fluid to be achieved at the heat exchange component and the amount of heat to be extracted from the bled motive fluid at the heat exchange component. The target temperature determines the amount of motive fluid related heat to be extracted via bleeding exit 67.

The remaining portion of the expanded motive fluid vapors, usually expanded motive fluid vapors, not extracted via passage 63 and bleeding exit 67 is fed to the nozzle ring of the subsequent turbine wheel stage, after flowing across passage 63. The rate of feeding from one stage to another is determined by the pressure difference between adjacent expansion stages, while taking into consideration the bleeding motive fluid flow as well.

Although interstage bleeding is known from the prior art, such as U.S. Pat. No. 7,797,940, a Continuation-in part case of U.S. Pat. No. 7,775,045, the disclosures of which are hereby incorporated by reference, the prior art interstage bleeding is carried out only with respect to only up to three turbine wheels known in the prior art, while turbine 60 of the present invention is able to facilitate interstage bleeding with the use of at least four turbine wheels. Turbine 60 is therefore able to produce higher power levels by virtue of the four turbine wheels as a result of the larger difference between vaporizer and condenser pressure that is able to be achieved due to a relatively high enthalpy difference, and the power plant in which turbine 60 is incorporated is able to realize an increased thermal efficiency.

Figure 7:
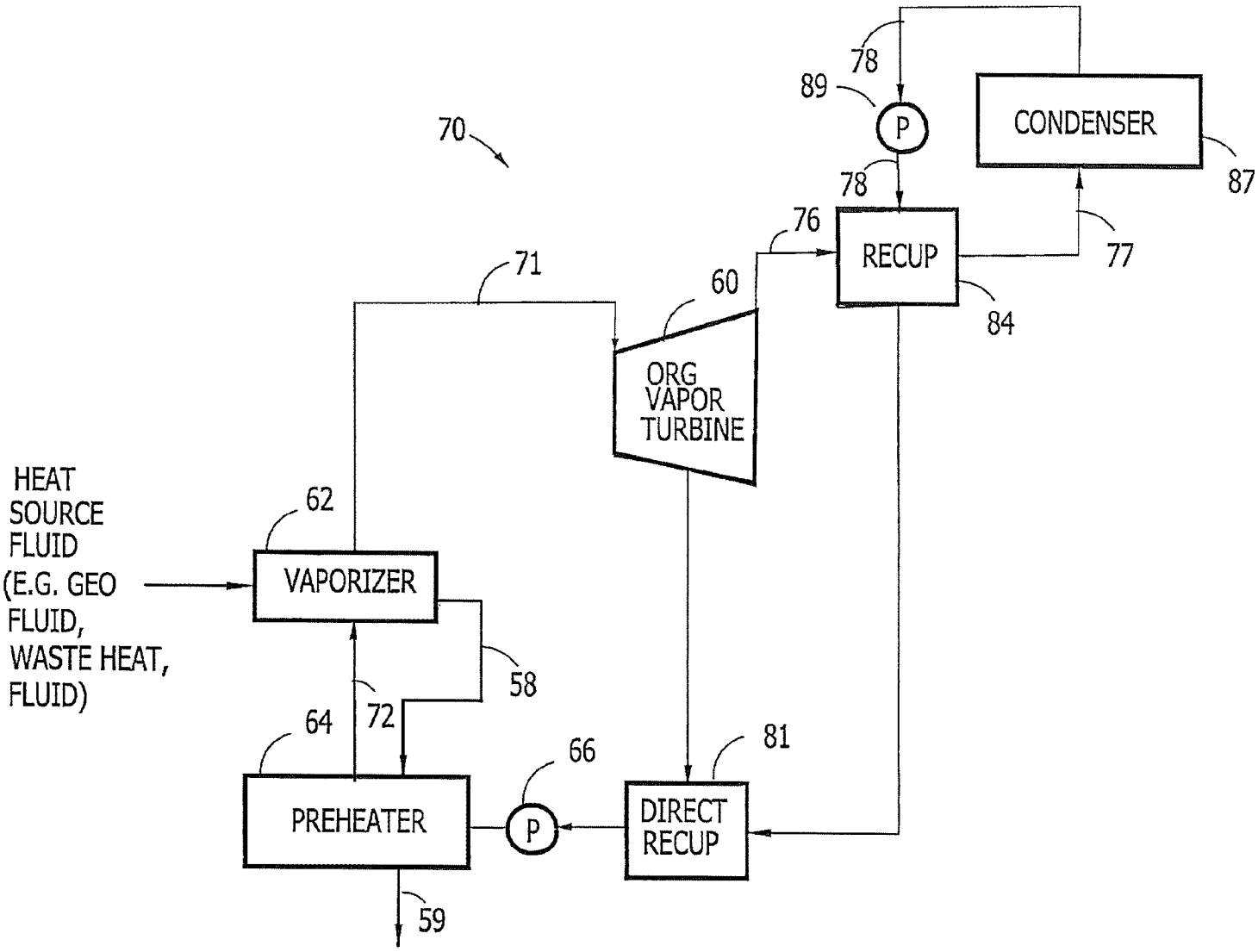
FIGS. 7, 7A-9 are three schematic illustrations, respectively, of a power plant according to different embodiments of the invention.

FIG. 7 illustrates a power plant 70 according to one embodiment of the invention that effectively utilizes the heat content of bled motive fluid vapor by means of a direct recuperator 81 to which the bled vapor is supplied.

The use of a recuperator is suited for an ORC since the cycled organic motive fluid expands in turbine 60 in a dry superheated regime and the recuperator permits the recovery of the heat contained in the superheated vapor exiting the turbine or extracted from the turbine by utilizing this heat within in the ORC cycle. In power plant 70, the heat content of the expanded organic vapor is optimally utilized by advantageously employing both a direct recuperator 81 and an indirect recuperator 84.

The completely expanded organic motive fluid exhausted from the last stage turbine wheel of turbine 60, after work has been performed, is delivered via conduit 76 to indirect recuperator 84. The organic vapor exits indirect recuperator 84 via conduit 77 and is delivered to condenser 87 which may be air-cooled or water cooled and which condenses the vapor by means of a cooling fluid (not shown). The condensed motive fluid is supplied by condensate pump 89 via conduit 78 to indirect recuperator 84, which is adapted to transfer heat from the turbine exhaust to the condensed motive fluid or motive fluid condensate, and then via conduit 79 to direct recuperator 81.

The interstage-bled motive fluid vapor is extracted via conduit 74 to direct recuperator 81, and is brought in direct contact with the liquid motive fluid condensate that has exited indirect recuperator 84. Direct recuperator 81 may be configured in several ways, for example as a spray whereby the motive fluid condensate is sprayed into the interior space of direct recuperator 81 to contact the interstage-bled motive fluid vapor introduced therein. The interstage-bled motive fluid vapor is caused to condense following contact with the lower temperature liquid condensate droplets, which provide a relatively large heat transfer surface area. Latent heat of the interstage-bled motive fluid vapor is released during condensation and heats the motive fluid liquid condensate.

The further heated condensate produced exiting direct recuperator 81 is pressurized by feed pump 66, and is delivered via conduit 73 to preheater 64 and then via conduit 72 to vaporizer 62. Vaporizer 62 vaporizes the preheated motive fluid, and the motive fluid vapor is supplied to organic vapor turbine 60 via conduit 71, and specifically to the nozzle ring of the first turbine wheel stage.

In this fashion, a significant increase in heat influx is provided to the motive fluid by thermal energy, despite the extraction of heat at an intermediate stage of the turbine and despite the relatively low pressure differential between the interstage-bled motive fluid vapor and the recuperated motive fluid liquid. As a consequence, an increased level of power output can be extracted from the turbine.

A suitable heat source fluid, such as geothermal fluid e.g. geothermal steam or geothermal brine or waste heat, etc., is introduced to vaporizer 62 and is brought in heat exchanger relation with the preheated motive fluid in order to vaporize the latter. The heat-depleted heat source fluid exits vaporizer 62 via conduit 58 and is supplied to preheater 64, and preheats the motive fluid liquid supplied by feed pump 66. When the heat source fluid is geothermal fluid, it flows in an open cycle and is advantageously re-injected into an injection well via conduit 59 after exiting preheater 64. For some heat source fluids such as heat transfer fluid e.g. thermal oil, the heat source fluid recirculates within a closed cycle.

The use of direct recuperator 81 is of particular benefit when the heat source fluid is geothermal fluid, e.g. brine, since at times it is preferred that additional heat should not be extracted from the heat source. The additional heat influx provided by direct recuperator 81 thus provides compensation as far as heat is concerned.

It is to be pointed out that while recuperator 81 is described as a direct recuperator in which direct contact is made between the organic motive fluid vapor bled from passage 63 and the organic motive fluid condensate supplied from indirect recuperator 84, advantageously, recuperator 81 can be an indirect recuperator so that heat contained in heat contained in the organic motive fluid vapor bleed can be indirectly transferred to organic motive fluid condensate supplied from indirect recuperator 84.

Figure 7A:
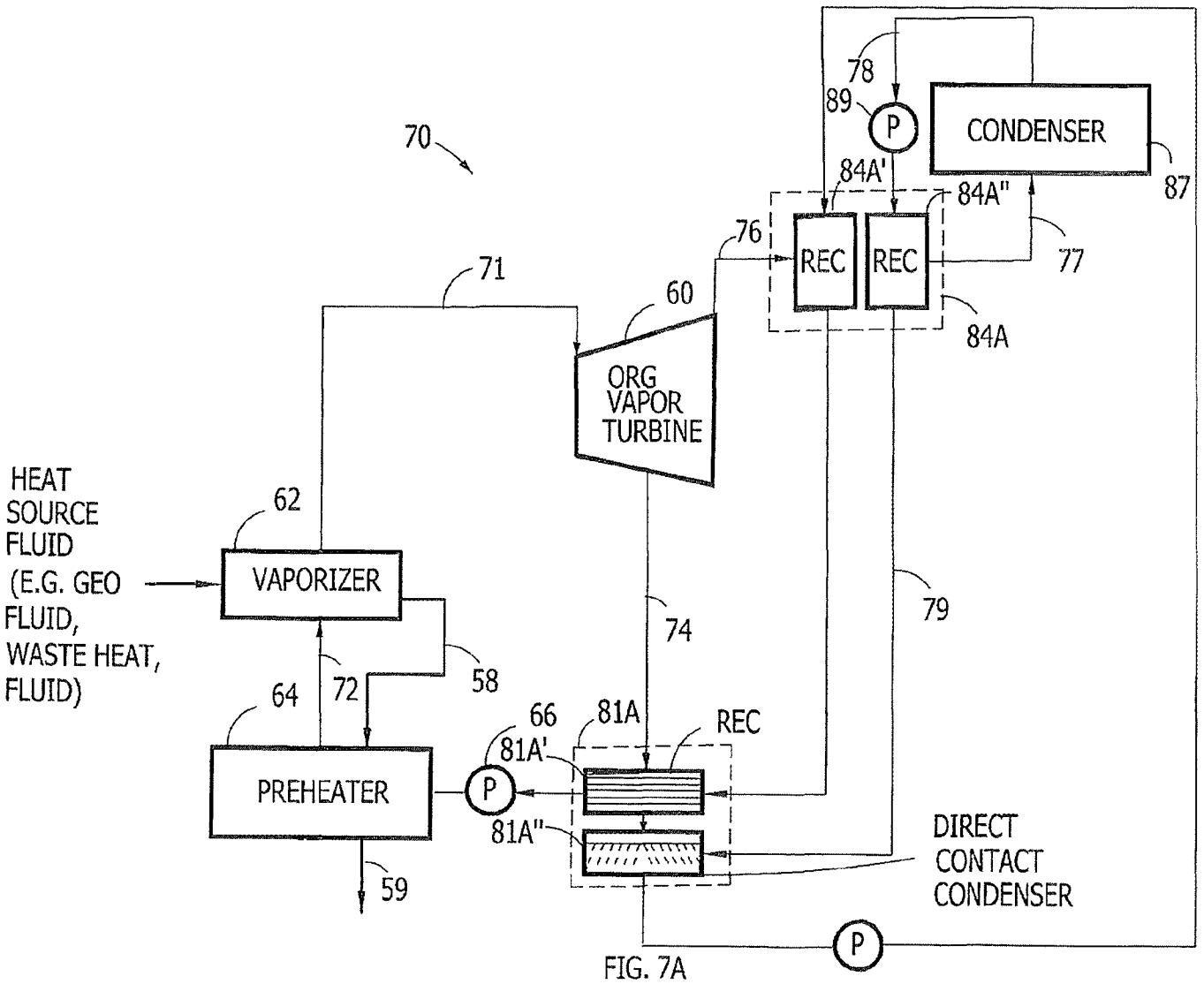

FIG. 7A illustrates another embodiment of power plant 70 according to one embodiment of the invention that effectively utilizes the heat content of bled motive fluid. Although this embodiment is similar to the embodiment of the present invention described with reference to FIG. 7, in the embodiment described with reference to FIG. 7A, rather than using direct contact recuperator 81 to utilize the heat present in the bled motive fluid 74, usually bled organic motive fluid, heat exchanger 81A is provided, to which the bled motive flow 74 flows and is made up of 2 heat exchangers or 2 heat exchanger sections, heat exchanger 81A' and heat exchanger 81A". In addition, in this embodiment, as shown in FIG. 7A, indirect recuperator 84A is made up of 2 recuperators, recuperator 84A' and recuperator 84A". Heat exchanger 81A' is an indirect recuperator and transfers sensible heat from the bled motive fluid vapor 74 to heated motive fluid condensate supplied from condenser 87 via indirect recuperator 84A' of indirect recuperator 84A. The further heated motive fluid condensate thus produced is supplied from indirect recuperator 81A' to preheater 64, with the preheated motive fluid being supplied thereafter to vaporizer 62. Furthermore, heat-depleted motive fluid bleed vapor exiting indirect recuperator 81A' is supplied to direct contact condenser 81A" where it is condensed by heated motive fluid condensate supplied from further indirect recuperator 84A". In such a manner, latent heat present in the heat-depleted motive fluid bleed vapor exiting indirect recuperator 81A' is transferred to heated motive fluid condensate supplied from indirect recuperator 84A" and further heated motive fluid condensate is produced. This further heated motive fluid condensate is supplied to first indirect recuperator 84A' of indirect recuperator 84A where it is additionally heated by expanded motive fluid vapor exhausted from vapor turbine 60. This additionally heated motive fluid condensate is then supplied to indirect recuperator 81A' where it is heated still further. Advantageously, indirect recuperator 84A can be, in this embodiment, a single indirect recuperator. Furthermore, if desired, direct contact condenser 81A" can be a surface or indirect contact condenser. Moreover, while indirect recuperator 81A' heats the heated motive fluid condensate supplied from indirect recuperator 84A' and direct contact condenser 81A" cools the motive fluid bleed vapor, their operating temperatures need not be related.

Figure 8:
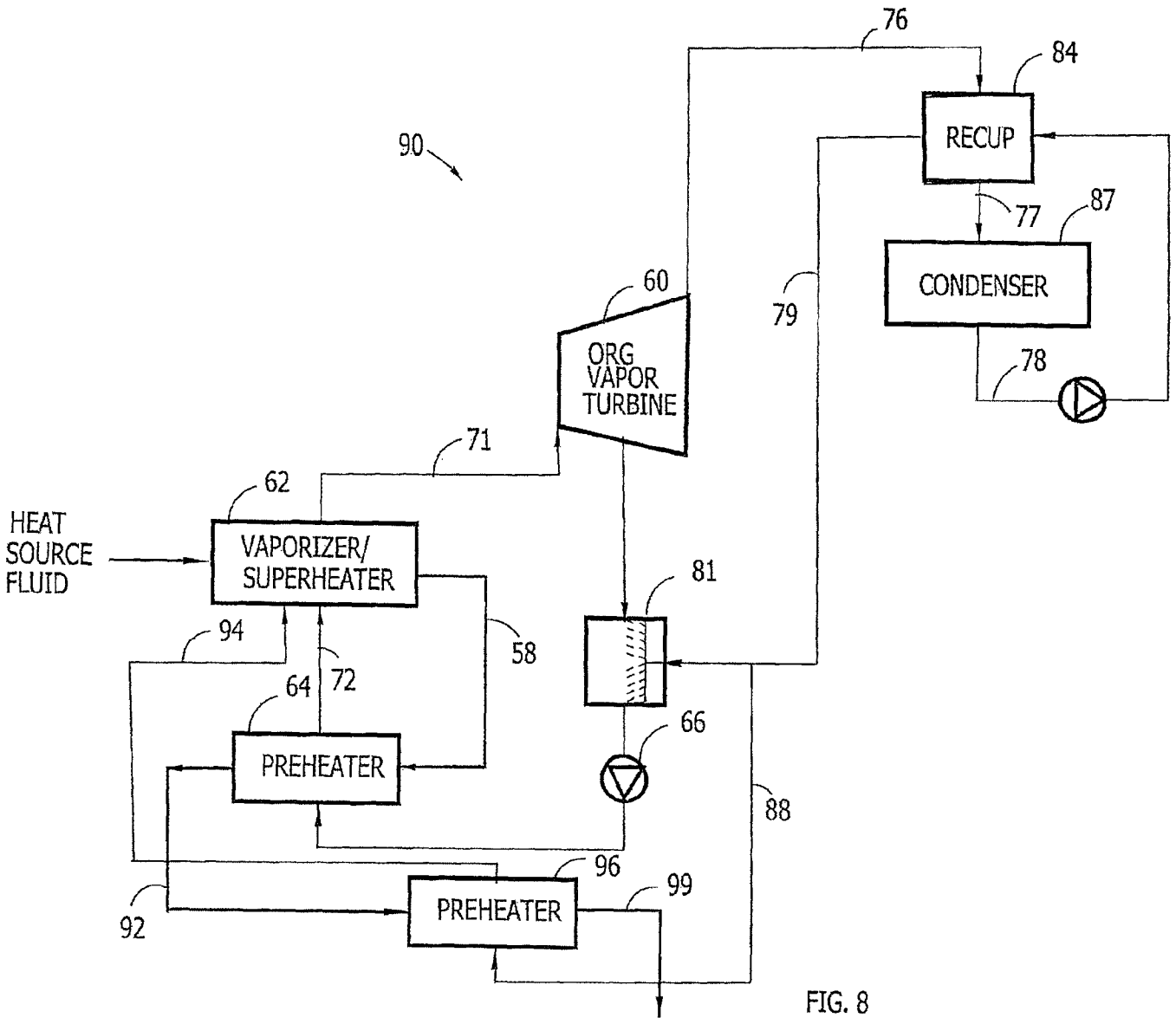

FIG. 8 illustrates a further embodiment of an ORC cycle enhanced by direct recuperation and interstage bleeding.

Power plant 90 is similar to power plant 70 of FIG. 7, employing organic vapor turbine 60 adapted for interstage bleeding, vaporizer 62 for vaporizing and/or superheating the organic motive fluid, preheater 64, direct recuperator 81, indirect recuperator 84 and condenser 87. In addition, power plant 90 comprises secondary preheater 96 which receives the heat-depleted heat source fluid from primary preheater 64 via conduit 92 in order to additionally heat the recuperated motive fluid liquid exiting indirect recuperator 84. Here, also, the interstage-bled motive fluid vapor extracted via conduit 74 to direct recuperator 81 is brought into direct contact with the liquid motive fluid condensate that has exited indirect recuperator 84. The further heated condensate produced exiting direct recuperator 81 is pressurized by feed pump 66, and is delivered via conduit 73 to primary preheater 64 and then via conduit 72 to vaporizer 62. In addition, in the present embodiment, a further portion of the recuperated motive fluid liquid is directed from indirect recuperator 84 to secondary preheater 96 via conduit 88, which branches from conduit 79. The additionally heated recuperated motive fluid liquid exiting secondary preheater 96 is supplied to vaporizer 62 via conduit 94, enabling a higher cycle efficiency level to be achieved so that more power may be produced by turbine 60. The heat source fluid exiting secondary preheater 96 is discharged via conduit 99, or alternatively is recirculated via a closed cycle.

Figure 9:
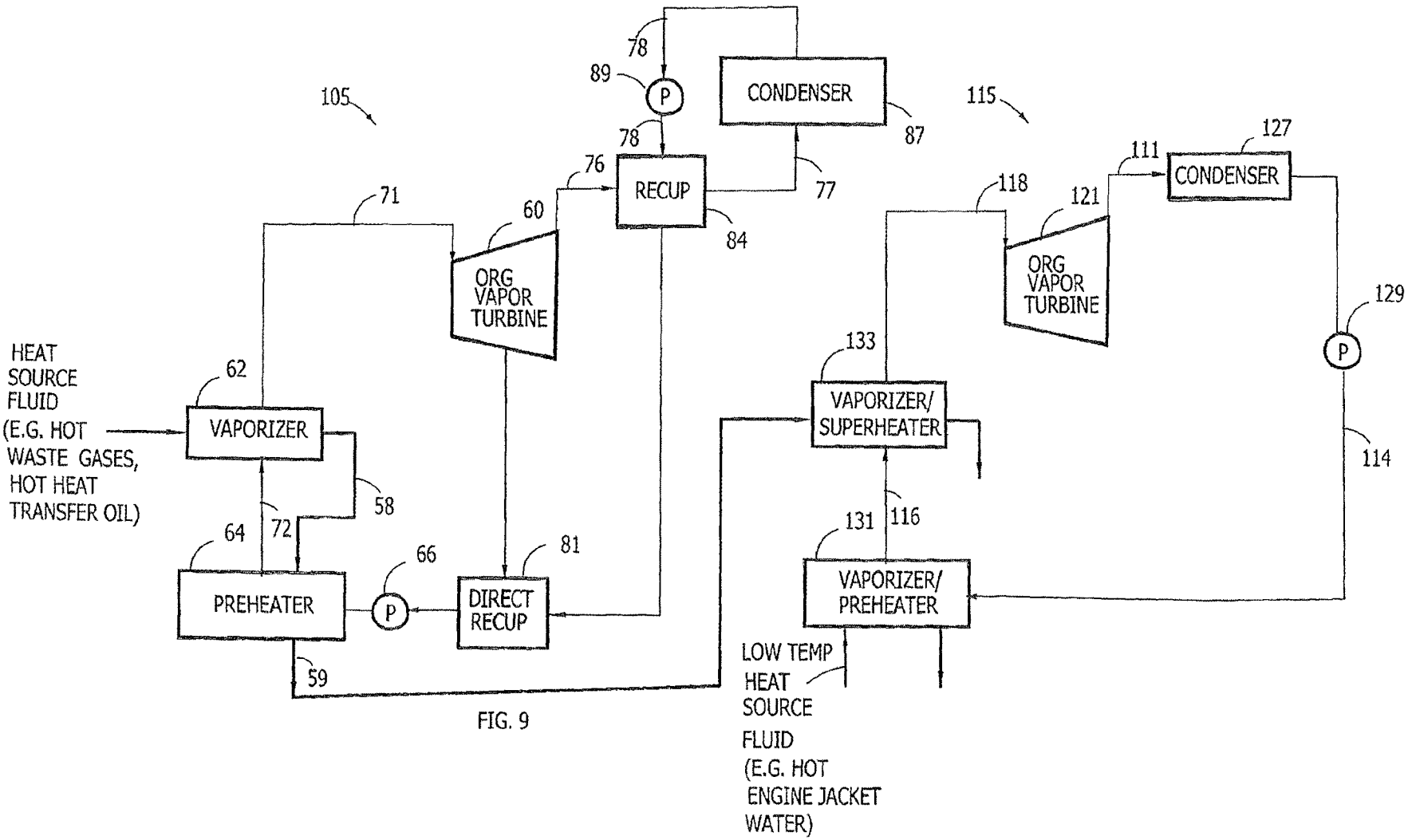

FIG. 9 illustrates another embodiment of an ORC cycle enhanced by direct recuperation and interstage bleeding, for use in utilizing both a high temperature heat source and a low temperature heat source. Low temperature heat sources such as engine jacket water heretofore have suffered from low thermal efficiencies due to the relatively low temperatures at which the motive fluid in heat exchanger relation therewith is able to be vaporized. The thermal efficiency can advantageously be improved by having both a high temperature cycle and a low temperature cycle, and utilizing a portion of the high temperature heat source for heating the organic motive fluid in the low temperature cycle.

In this embodiment, power plant 110 comprises two independent closed ORC loops, a high temperature cycle 105 and a low temperature cycle 115. Both the turbine of high temperature cycle 105 and the turbine of low temperature cycle 115 may be coupled to a common generator for producing electricity.

High temperature cycle 105 is similar to power plant 70 of FIG. 7, employing organic vapor turbine 60 adapted for interstage bleeding, vaporizer 62 for vaporizing or superheating the organic motive fluid by a high temperature heat source fluid such as hot waste gases, geothermal fluid or hot heat transfer oil, preheater 64, direct recuperator 81, indirect recuperator 84 and condenser 87. Also in this embodiment, high temperature cycle 105 can use a power plant similar to that described with reference to FIG. 7A.

Low temperature cycle 115 comprises organic vapor turbine 121 not utilizing interstage-bleeding, condenser 127 for receiving the expanded motive fluid vapor exhausted from the last stage of turbine 121 via conduit 111 and for condensing the same by a suitable cooling medium (e.g. air or water), condensate pump 129 for supplying the condensate via conduit 114 to preheater 131 and to which a low temperature heat source fluid is supplied in order to increase the temperature of the condensate received from pump 129, and vaporizer 133 for vaporizing the preheated motive fluid flowing thereto via conduit 116. The low temperature motive fluid vapor produced is supplied to turbine 121 via conduit 118.

The heat-depleted high temperature heat source fluid exiting vaporizer 62 of high temperature cycle 105 flows via conduit 58 to preheater 64, and preheats the motive fluid liquid supplied from direct recuperator 81 by feed pump 66. The heat depleted high temperature heat source fluid exiting preheater 64 is supplied through conduit 109 to vaporizer 133 of low temperature cycle 115. Even though the high temperature heat source fluid is additionally heat-depleted, its heat content is sufficiently high to vaporize the preheated low temperature motive fluid liquid.

Figure 11:
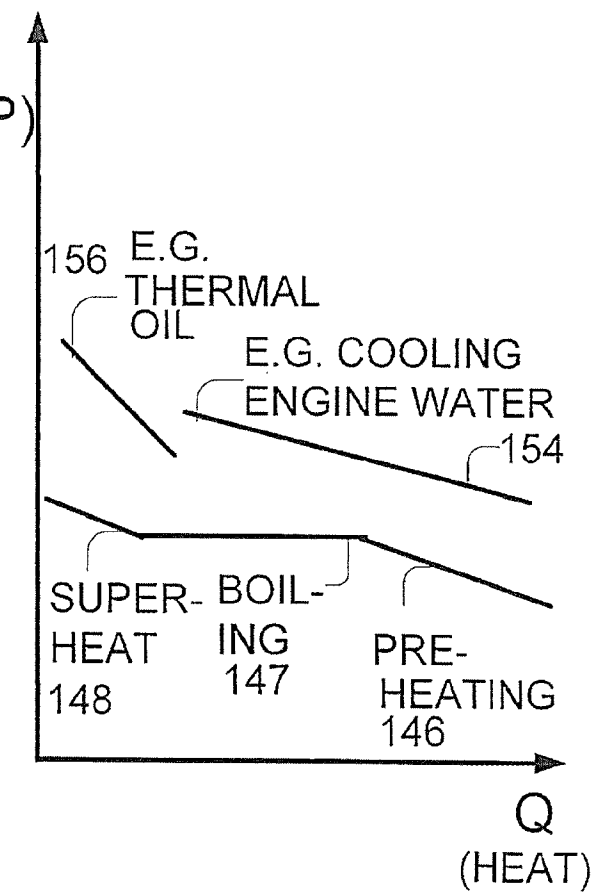
FIGS. 10-11 are two temperature/heat diagrams, respectively, for the power plant of FIG. 9.
Figure 10:
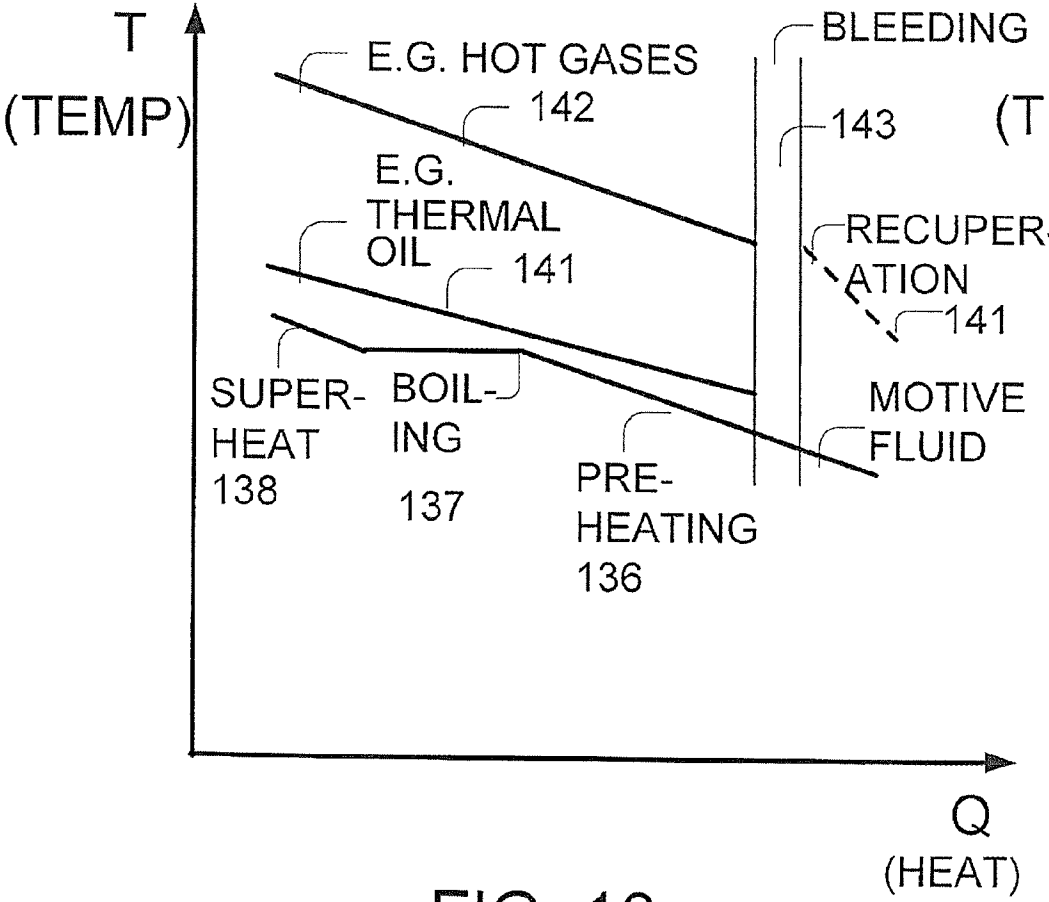

FIGS. 10 and 11 illustrate two temperature/heat diagrams for the high temperature cycle and low temperature cycle, respectively, of FIG. 9 wherein the different heat transfer processes are shown.

Referring to FIG. 10, line 136 represents the preheating of the organic motive fluid in the high temperature cycle. Line 137 represents the boiling of the motive fluid while line 138 represents the superheating of the motive fluid, if taking place, within the vaporizer, in response to the heat influx provided by the high-temperature heat source fluid, whether thermal oil as indicated by line 141 or hot gases as indicated by line 142.

stage organic motive fluid turbine, if desired, the present invention and is embodiments can be practiced wherein less expansion stages are used in the multi-stage turbine.

Line 145 represents the heat influx to the motive fluid in response to flowing through the indirect recuperator 84, while the direct recuperation or bleeding process is shown in a further segment (designated 143), after the motive fluid vapor having been expanded in the turbine, extracted and condensed. Consequently, the injection of the directly recuperated motive fluid into the preheater of the high temperature cycle obviates the need of having to exploit a substantial amount of heat from the heat source fluid in the high temperature cycle. Thus, the heat content of the heat source fluid exiting the preheater remains sufficiently high to enable its use in the low temperature cycle.

In FIG. 11, line 146 represents the preheating of the organic motive fluid in the low temperature cycle provided by the low temperature heat source fluid, as indicated by line 154. Line 147 represents the boiling of the motive fluid and line 148 represents the superheating thereof, if taking place, within the vaporizer, in response to the heat influx provided by the heat source fluid, for example, thermal oil (from the high temperature cycle) as indicated by line 156 whose starting temperature is substantially equal to the ending temperature of line 141.

While the description of the present invention refers to interstage bleeding of motive fluid vapor, in accordance with present invention, injection of motive fluid, such as organic motive fluid, can be used in the multi-stage turbine of the present invention.

Furthermore, while the present description of the present invention and its embodiments refers to a multi-stage turbine, e.g. a four-stage expansion turbine, the present invention and its embodiments can be practiced in a turbine having less than four stages. In addition, the present invention and its embodiments can also be practiced in a turbine having more than four stages While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A single turbine module, comprising:

a vaporizer for vaporizing organic motive fluid to be expanded in the turbine module;

four axially spaced turbine wheels, each of which turbine wheels constitutes one expansion stage of said turbine module, the turbine wheels being connected to a common turbine shaft and being coaxial therewith;

an inlet through which organic motive fluid vapor is introduced to a first stage of said turbine wheels;

a structured bleeding exit opening formed in an outer turbine casing of said turbine module;

a radial passage defined between two of said turbine wheels and in fluid communication with said bleeding exit opening, wherein partially expanded organic motive fluid vapor is extracted through said bleeding exit opening and supplied to an indirect recuperator in which heat from said partially expanded organic motive fluid vapor extracted through said bleeding exit opening is indirectly transferred to organic motive fluid condensate to produce indirectly recuperated organic motive fluid condensate to be supplied to a preheater for preheating the indirectly recuperated organic motive fluid condensate prior to supplying it to the vaporizer, such that heat from a heat source fluid supplied to the vaporizer vaporizes the preheated organic motive fluid and heat-depleted heat source fluid exiting the vaporizer is supplied to said preheater so that the indirectly recuperated organic motive fluid condensate is preheated, wherein heat-depleted partially expanded organic motive fluid vapor bleed exiting said indirect recuperator is supplied to a direct contact condenser for condensing said heat-depleted partially expanded organic motive fluid vapor bleed with additional organic motive fluid condensate from an air or water cooled condenser so that heated organic motive fluid condensate is produced and supplied to a further indirect recuperator for extracting heat from expanded organic motive fluid vapor exiting a last expansion stage of said turbine module to produce said organic motive fluid condensate that is supplied to the indirect recuperator to be heated by the partially expanded organic motive fluid vapor.

2. The turbine module according to claim 1, wherein the radial passage is defined between third and fourth stages of said turbine wheels.

3. The turbine module according to claim 1, further comprising an annular shell positioned within the turbine casing that surrounds an expanded vapor chamber and is proximate to an exit of expanded organic motive fluid from the last expansion stage of said turbine wheels, to facilitate access to the turbine shaft and to the turbine wheels via an opening formed in said shell.

4. The turbine module according to claim 1, further comprising two axially spaced bearings for providing support to the turbine shaft, the two bearings comprising an inlet side bearing at a side of the turbine shaft closer to the inlet for an organic motive fluid vapor to be expanded by one or more of said four turbine wheels and an outlet side bearing at a side of the turbine shaft closer to an outlet for the organic motive fluid vapor expanded by said one or more of said four turbine wheels, wherein said turbine shaft, said two spaced bearings, and said four turbine wheels are all coaxial, a solid bearing housing which surrounds said outlet side bearing to protect said outlet side bearing from overheating by the organic motive fluid expanded by said one or more of said four turbine wheels, and bearing support for said solid bearing housing, which bearing support comprises a conduit for a lubricating medium for lubricating said outlet side bearing.

5. The turbine module according to claim 4, wherein the outlet side bearing comprises a roller bearing which is located within a convergent cone and farther from the inlet for the organic motive fluid vapor to be expanded by one or more of the four turbine wheels.

6. The turbine module according to claim 4, wherein the turbine casing includes an expanded vapor chamber through which flows the organic motive fluid vapor expanded in one or more of the four turbine wheels, and a convergent cone defining an inner surface of said expanded vapor chamber, wherein the solid bearing housing is located within said convergent cone, which solid bearing housing contains and encases said outlet side bearing of said turbine module, wherein the turbine module further comprises a seal contained within the solid bearing housing and in communication with said lubricating medium, wherein said seal is in sealing engagement with the turbine shaft and in sealing relationship with an inlet end side of said outlet side bearing, the sealing relationship being sufficient such that the organic motive fluid vapor does not pass between said seal and said outlet side bearing, for preventing ingress of organic motive fluid vapors and impingement of hot unexpanded motive fluid onto the inlet end side of said outlet side bearing.

7. The turbine module according to claim 6, wherein the solid bearing housing is supported by means of a plurality of elongated and angularly spaced ones of said bearing support, wherein said bearing supports are each connected to a peripheral region of the solid bearing housing and to a region of the turbine casing of the turbine.

8. The turbine module according to claim 7, wherein each of the bearing supports of said solid bearing housing containing and encasing said outlet side bearing of said turbine module is tangentially connected to the peripheral region of the solid bearing housing to facilitate absorption of a moment by the turbine after being transmitted thereto by the outlet side bearing and the bearing support.

9. The turbine module according to claim 7, wherein the conduit through which the lubricating medium is supplied is a longitudinally extending bore formed in a first of the plurality of bearing supports.

10. The turbine module according to claim 9, wherein a second of said plurality of bearing supports is provided with a longitudinally extending bore from which spent lubricating medium is extracted from the outlet side bearing.

11. The turbine module according to claim 10, wherein a third of the plurality of bearing supports of said solid bearing housing containing and encasing said outlet side bearing of said turbine module is provided with a longitudinally extending bore through which cooled organic motive fluid condensate is injected to cool the outlet side bearing and said seal.

12. The turbine module according to claim 4, wherein the two spaced bearings provide the turbine shaft with sufficient tensile strength to support the four turbine wheels.

13. The turbine module according to claim 1 wherein further heated organic motive fluid condensate exiting said further indirect recuperator is supplied to said indirect recuperator.

14. The turbine module according to claim 13 wherein said additional organic motive fluid condensate supplied to said direct-contact condenser is supplied via an additional indirect recuperator such that said additional organic motive fluid condensate supplied to said direct-contact condenser is heated in said additional indirect recuperator by heat from expanded organic motive fluid vapor exiting said last expansion stage of said single turbine module, so that heat-depleted expanded organic motive fluid vapor exiting said additional indirect recuperator is supplied to said air or water cooled condenser.

15. The turbine module according to claim 1, wherein the vaporizer produces the organic motive fluid vapor from heat extracted from a low temperature geothermal fluid, thermal oil or waste heat fluid.

16. The turbine module according to claim 15, wherein the vaporizer produces the organic motive fluid vapor from heat extracted from a low temperature geothermal brine.

17. A method of utilizing heat content of an organic motive fluid vapor, comprising:

vaporizing an organic motive fluid in a vaporizer supplied with heat from a heat source fluid;

expanding the vaporized organic motive fluid vapor by introducing the vaporized organic motive fluid vapor to a first stage of an organic vapor turbine module comprising a plurality of axially spaced turbine wheels, each of which turbine wheels constitutes one expansion stage of said organic vapor turbine module;

bleeding partially expanded organic motive fluid vapor at a location between two of said turbine wheels, via a bleed opening formed in an outer turbine casing of said organic vapor turbine module;

supplying the bled, partially expanded organic motive fluid vapor to an indirect organic vapor recuperator in which heat from said bled, partially expanded organic motive fluid vapor is indirectly transferred to organic motive fluid condensate to produce indirectly recuperated organic motive fluid;

supplying heat-depleted partially expanded organic motive fluid vapor bleed exiting said indirect organic vapor recuperator to a direct contact condenser which is supplied with additional organic motive fluid condensate from an air or water cooled condenser, to produce and supply heated organic motive fluid condensate to a further indirect recuperator, wherein heat from expanded motive fluid vapor exiting a last stage of said organic vapor turbine module is extracted by said further indirect recuperator to produce said organic motive fluid condensate that is supplied to the indirect organic vapor recuperator to be heated by the bled, partially expanded organic motive fluid vapor;

supplying the indirectly recuperated organic motive fluid to a preheater for preheating the indirectly recuperated organic motive fluid to produce preheated organic motive fluid, wherein heat-depleted heat source fluid exiting the vaporizer is supplied to said preheater; and supplying the preheated organic motive fluid to the vaporizer.

18. The method according to claim 17, wherein said additional organic motive fluid condensate supplied to said direct-contact condenser is supplied via an additional indirect recuperator, such that heat-depleted expanded motive fluid vapor exiting said further indirect recuperator heats said additional organic motive fluid condensate prior to said additional organic motive fluid condensate being supplied to said direct contact condenser.

19. The method according to claim 17, wherein the heat source fluid is geothermal brine, geothermal steam, thermal oil, or waste heat fluid that is supplied to the vaporizer.

20. The method according to claim 17, further comprising the steps of:

providing support for a turbine shaft, to which the plurality of turbine wheels are connected, using two axially spaced bearings, the two bearings comprising an inlet side bearing at a side of the turbine shaft closer to an inlet of the organic motive fluid vapor to be expanded by one or more of said plurality of turbine wheels, and an outlet side bearing, said outlet side bearing comprising a roller bearing and being located after the last stage of said plurality of turbine wheels farther from said inlet and proximate to an expanded vapor chamber, wherein said turbine shaft, said two spaced bearings, and said plurality of turbine wheels are all coaxial;

providing a solid bearing cartridge, which solid bearing cartridge contains and encases said outlet side bearing, wherein a lubricating medium is supplied to said solid bearing cartridge to protect said outlet side bearing from overheating by said organic motive fluid; and providing a seal contained within said solid bearing cartridge and in communication with said lubricating medium, wherein said seal is in sealing engagement with the turbine shaft and in sealing relationship with an inlet end side of said outlet side bearing, the sealing relationship being sufficient such that the organic motive fluid vapor does not pass between said seal and said outlet side bearing, for preventing ingress of organic motive fluid vapors and impingement of hot unexpanded organic motive fluid onto the inlet end side of said outlet side bearing.

21. The method according to claim 20 wherein the step of introducing the organic motive fluid vapor to the first stage of the organic vapor turbine module is carried out by:

providing the organic vapor turbine module with four expansion stages;

supplying the organic motive fluid vapor to the inlet of the first stage of the organic vapor turbine module; and expanding the organic motive fluid vapor in said four expansion stages to produce power and to produce expanded organic motive fluid vapor in the expanded vapor chamber.

* * * * *